US008479653B2

(12) United States Patent
Bar et al.

(10) Patent No.: US 8,479,653 B2
(45) Date of Patent: Jul. 9, 2013

(54) LOW-VULNERABILITY PYROTECHNICAL CHARGE

(75) Inventors: Christophe Bar, Olivet (FR); Alain Dousset, Ingre (FR); David Fayel, Olivet (FR)

(73) Assignee: TDA Armements SAS, La Ferte Saint-Aubin (FR)

( * ) Notice: Subject to any disclaimer, the term of this patent is extended or adjusted under 35 U.S.C. 154(b) by 20 days.

(21) Appl. No.: 13/139,304

(22) PCT Filed: Dec. 8, 2009

(86) PCT No.: PCT/EP2009/066655

§ 371 (c)(1), (2), (4) Date: Aug. 29, 2011

(87) PCT Pub. No.: WO2010/066752

PCT Pub. Date: Jun. 17, 2010

(65) Prior Publication Data

US 2011/0308416 A1 Dec. 22, 2011

(30) Foreign Application Priority Data

Dec. 12, 2008 (FR) ..... 08 07002

(51) Int. Cl.
*F42B 4/00* (2006.01)

(52) U.S. Cl.
USPC ..... 102/335; 102/310; 102/320

(58) Field of Classification Search
USPC ..... 102/335, 301–311, 270, 320, 352, 102/360
See application file for complete search history.

(56) References Cited

U.S. PATENT DOCUMENTS

| | | | | |
|---|---|---|---|---|
| 3,430,563 | A | 3/1969 | Stresau | |
| 3,896,731 | A | 7/1975 | Kilmer | |
| 3,949,674 | A | 4/1976 | Talley | |
| 4,145,972 | A | 3/1979 | Menz et al. | |
| 6,427,599 | B1 * | 8/2002 | Posson et al. | 102/336 |

FOREIGN PATENT DOCUMENTS

| | | | |
|---|---|---|---|
| FR | 2 388 468 | A | 11/1978 |
| FR | 2 896 577 | A1 | 7/2007 |

* cited by examiner

*Primary Examiner* — Michael David
(74) *Attorney, Agent, or Firm* — Baker & Hostetler, LLP

(57) ABSTRACT

Pyrotechnic charges that include an explosion generator and an explosive having an outer surface divided into n segments, each segment having kq multiple ignition points for the explosive, k and q being integer numbers greater than 1. The kq multiple ignition points for the explosive are linked by ignition lines forming, for each segment, at least two interleaved partial networks for synchronous ignition of the kq multiple ignition points, each of the partial synchronous ignition networks being linked to a respective partial network detonator.

14 Claims, 6 Drawing Sheets

LOW-VULNERABILITY PYROTECHNICAL CHARGE

CROSS-REFERENCE TO RELATED APPLICATIONS

This application is a National Stage of International patent application PCT/EP2009/066655, filed on Dec. 8, 2009, which claims priority to foreign French patent application No. FR 08 07002, filed on Dec. 12, 2008, the disclosures of each of which are incorporated by reference in their entireties.

FIELD OF THE INVENTION

The invention relates to pyrotechnic charges, notably those used in the oriented multiple burst military domain.

BACKGROUND OF THE INVENTION

The military warheads, such as those of missiles, rockets, etc., comprise pyrotechnic charges intended to destroy or damage a target located nearby. The activation of the charge is controlled by electronic devices embedded in the military warhead detecting the presence and the position of the target to be destroyed.

The military devices that include such pyrotechnic charges and their ignition devices are constantly changing to become more effective while offering a high level of vulnerability to external attacks, for example to the explosions due to the explosion of other charges, bullets, etc.

FIG. 1 represents a conventional configuration of a pyrotechnic charge with little vulnerability to external attacks.

In the configuration of FIG. 1, the pyrotechnic charge comprises an explosion-generating jacket 10 containing an explosive 12 having, in its central part, a sensitive pyrotechnic part 14, or detonator, which, when activated, for example by the sending of an electric pulse by a computation unit (not represented in the figure) determining the presence of a the target C, initiates the detonation of the explosive.

The ignition of the explosive causes the jacket 10 to explode producing bursts of explosions over a solid angle of 360°.

The effectiveness of such a pyrotechnic charge is low because the explosions are dispersed in all directions in space (arrows in FIG. 1) and few explosions are directed toward the target C.

However, this type of pyrotechnic charge of FIG. 1 offers little vulnerability to external attacks because the detonator 14 is at the center of the charge and the probability of its activation by an explosion or a bullet coming from outside is low.

FIG. 2 shows another embodiment of a pyrotechnic charge of the state of the art offering a better target destruction effectiveness.

In this embodiment of FIG. 2, an explosion generator 20 is placed at the center of an explosive charge 22 and multiple detonators 24 are distributed over the periphery of same explosive charge. A system for detecting the presence of the target triggers a single detonator 24 on the side of the charge 22 opposite the target C which propels all the explosions of the explosion generator 20 solely in the direction of the target (all the arrows in FIG. 2).

The advantage of this pyrotechnic charge configuration with selection of the detonator lies in its effectiveness in destroying the target but has the drawback of high vulnerability to external attacks. In practice, the probability of an explosion or another projectile reaching one of the external detonators 22, 24 on the periphery of the charge is fairly high.

In other military charge applications comprising an explosion generator inside the charge, the main explosive loading is ignited over a large surface area of the periphery of the pyrotechnic charge synchronously, instead of a one-off ignition as represented in FIG. 2.

For this type of ignition over a large surface area, the pyrotechnic charges of the state of the art comprise multiple ignition networks consisting of a distribution of multiple ignition points based on detonic distribution nodes.

FIG. 3 shows an embodiment of a pyrotechnic charge according to the technique of peripheral ignition of the explosive charge by a network of multiple ignition points.

In this embodiment of FIG. 3, an explosion generator 30 is placed at the center of an explosive charge 32. The surface of the charge is divided into n segments S1, S2, . . . Si . . . Sn each comprising an ignition network R1, R2, . . . Ri . . . Rn, each of the networks comprising a respective detonator Dt1, Dt2, . . . Dtn for its activation.

All the n detonators of the ignition networks covering the peripheral surface of the charge are remotely sited in a single smart safety and ignition device (with the acronym DSMF) (not represented in the figure).

As in the case of the pyrotechnic charge of FIG. 2, the presence of the target C triggers the detonator and the ignition network of the segment of the charge located opposite the target C propelling a maximum burst of explosions toward the target. The burst of explosions oriented in this way toward the target is all the more effective by virtue of the planar ignition of the network.

FIG. 4 shows a partial view of an exemplary embodiment of the pyrotechnic charge of FIG. 3, of cylindrical shape, through a network of multiple ignition points.

The pyrotechnic charge of FIG. 4 comprises a jacket 40, for example made of Plexiglass, of cylindrical shape surrounding an explosive charge 42 in the form of a bar. A synchronous ignition network Ri, of a segment Si at the surface of the explosive charge, produced in the cylindrical jacket 40 by a regular distribution of crossmembers 44 perpendicular to the surface of the charge and grooves 46 parallel to said surface comprising a detonation product intended to be initiated by a detonator (not represented in the figure) sited remotely from the ignition surface.

The crossmembers 44 form the multiple ignition points on the surface of the explosive which are linked by the ignition lines embodied by the grooves 46 containing the detonation product.

The detonation product in the grooves transmits a detonation wave initiated by the remotely-sited detonator, in the manner of a fuse, to all the ignition points distributed over the segment concerned of the jacket of the pyrotechnic charge.

The network must be produced by observing certain constraints. For example, the spacing between the various lines of the network comprising the detonation product must be such that these lines do not interfere with one another.

The number and the position of the ignition outputs at the level of the crossmembers (or multiple ignition points) are defined so as to generate an initiation of the detonation of the explosive charge that is totally synchronous over all the surface concerned of the pyrotechnic charge.

Depending on the sensitivity of the loading explosive of the pyrotechnic charge and its critical diameter, that is to say, the surface area dimension below which the detonation is impossible to initiate, it is possible to define an output geometry of the network such that a unitary detonation output is incapable of initiating the loading directly, in other words, such that it is necessary to superpose the effects of multiple detonation outputs to obtain the nominal ignition conditions for the explosive loading.

FIG. 5 shows a network with multiple synchronous ignition points of the state of the art.

The network of FIG. 5 comprises 64 ignition points pa distributed according to a regular pitch Ps over the surface of a segment Si of a pyrotechnic charge forming a square of 8 by 8 synchronous ignition points.

These various ignition points pa are linked, from a central distribution point Ps of the network, by detonation lines Cd, so as to provoke synchronous activation of all the ignition points. The distances traveled by the detonation wave between this central point Ps and the ignition points, along the detonation lines, are identical which ensures a synchronous detonation of the ignition points activating all the surface of the segment concerned of the explosive charge.

Nevertheless, this pyrotechnic charge configuration represented in FIGS. 4 and 5 offers an excessive vulnerability to surrounding attacks. For example, an impact on the surface of the pyrotechnic charge may accidentally initiate an element of the network (point or line) and generate a propagation of detonations within the network, ascending and descending with the risk of partially obtaining a synchronous output effect that is sufficient to ignite, in a quasi-nominal manner, the main explosive loading.

This peripheral network ignition design thus represents a weakness in the military charge which makes it incompatible with the modern reduced vulnerability munitions specifications.

SUMMARY OF THE INVENTION

To overcome the drawbacks in the pyrotechnic charges of the state of the art, the invention proposes a pyrotechnic charge comprising an explosion generator and an explosive having an outer surface divided into n segments, each segment comprising kq multiple ignition points for the explosive, k and q being integer numbers greater than 1.

characterized in that the kq multiple ignition points for the explosive are linked by ignition lines forming, for each segment, at least two interleaved partial networks for the synchronous ignition of the kq multiple ignition points, each of the partial synchronous ignition networks being linked to a respective partial network detonator.

Advantageously, each segment of the outer surface of the explosive comprises two interleaved partial synchronous ignition networks.

In one embodiment, k and q being even numbers, the kq multiple ignition points form a part by half kq/2 of each of the two interleaved partial networks, each of the two halves of the multiple ignition points being distributed over the surface of the explosive of the segment concerned.

In another embodiment, the kq multiple ignition points of each of the segments are distributed over the surface of the explosive on k rows L1, L2, . . Lx, . . . Lk and q columns C1, C2, . . Cy, . . . Cq, x being the number of the row Lx and y being the number of the column Cy, and according to a distribution pitch Pp, a partial synchronous ignition network of a segment being obtained from the other synchronous ignition network of the same segment by rotation of 180° about an axis YY' parallel to the direction of the columns and passing through a respective central point of distribution of the ignition lines of each of the partial networks.

In another embodiment, a partial network comprises the ignition point p11, of the row L1 and the column C1, linked by an individual ignition line to the ignition point p22, of the column C2 and the row L2, to form an individual ignition pattern of the partial network, this individual ignition pattern of the partial network being repeated one ignition point out of two along the rows L1 to Lk and along the columns C1 to Cq, and in that the other partial network comprises the ignition point p12, of the row L1 and the column C2, linked by another individual ignition line to the ignition point p21, of the row L2 and the column C1, to form another individual ignition pattern of the other partial network, this other individual ignition pattern of the other partial network being repeated one ignition point out of two along the rows L1 to Lk and along the columns C1 to Cq.

In another embodiment, the centers of the respective individual ignition lines are linked by other ignition lines configured so that the distances traveled by the detonation waves for the detonators, of the segment concerned, applied to each respective central distribution point of the networks, to the multiple ignition points of the segment are identical, producing a synchronous activation of all said multiple ignition points of the two partial networks.

In another embodiment, the kq multiple ignition points are distributed over a square surface of perpendicular axes XX' parallel to the rows L1, L2, . . . Lk and YY' parallel to the columns C1, C2, . . . Cq of the partial networks and passing through the central distribution point.

In another embodiment, the segments comprise 64 multiple ignition points with k=p=8.

In another embodiment, the other ignition lines are:

- first lines linking the centers of two consecutive individual lines parallel to the axis XX',
- second lines parallel to the axis YY' linking the centers of two first lines,
- third lines parallel to the axis XX' linking the centers of two consecutive second lines along the axis XX',
- two last lines parallel to the axis YY' linking the centers of the two third lines to the central distribution point of the respective partial network.

In one embodiment, the explosion generator is on the periphery of the charge surrounding the explosive having a jacket over its outer surface comprising the multiple interleaved networks.

In another embodiment, the explosion generator is inside the charge having a jacket over its outer surface comprising the multiple interleaved networks.

One main objective of the invention is to make the pyrotechnic charges of military warheads much less vulnerable to the effects of external impacts.

Another objective is to produce distribution networks of initiation (or ignition) points for an explosive charge reducing the probability of untimely or accidental nominal ignition of the explosive charge.

BRIEF DESCRIPTION OF THE DRAWINGS

The invention will be better understood using an exemplary embodiment of a pyrotechnic charge according to the invention with reference to the appended figures in which.

DETAILED DESCRIPTION

Figure 1:
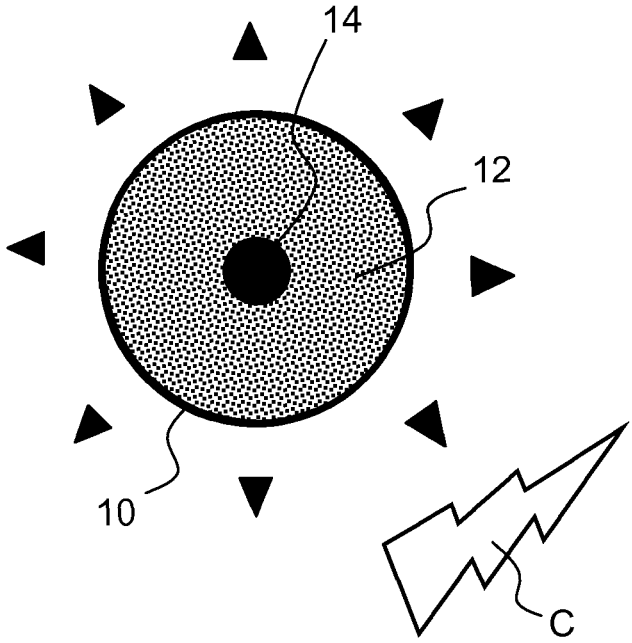
FIG. 1, already described, represents a conventional configuration of a pyrotechnic charge with little vulnerability to external attacks.
Figure 2:
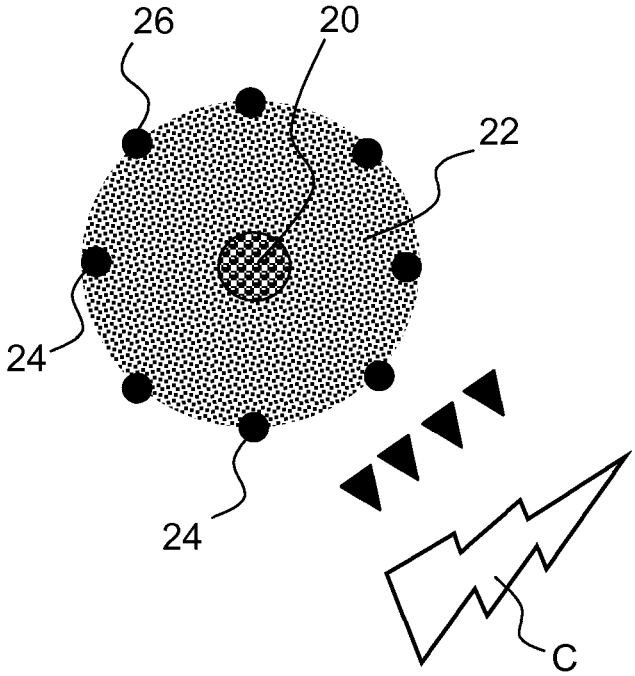
FIG. 2, already described, shows another embodiment of a pyrotechnic charge of the state of the art.
Figure 3:
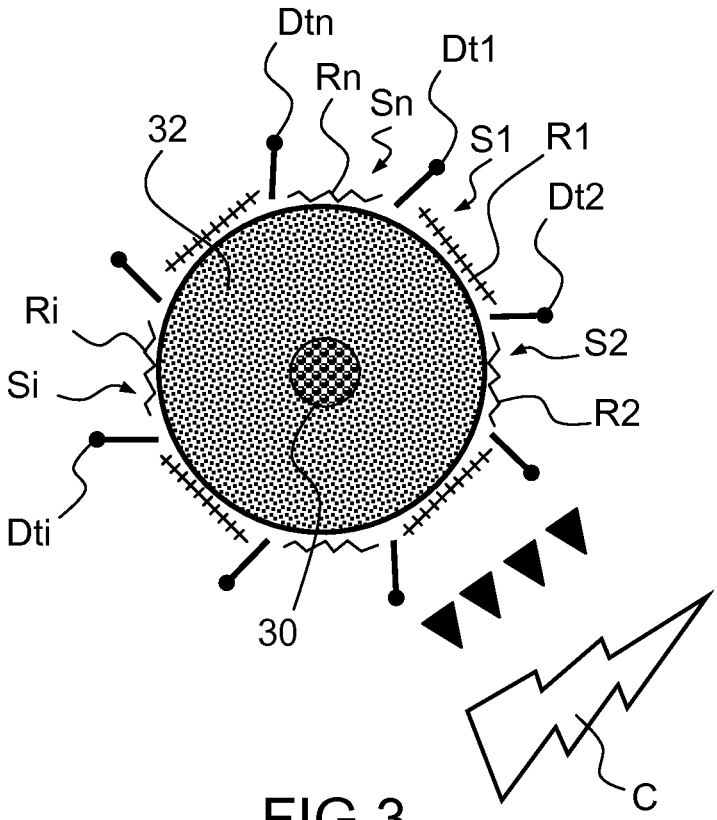
FIG. 3, already described, shows an embodiment of a pyrotechnic charge of the state of the art according to the technique of peripheral ignition of the explosive charge via a network with multiple ignition points.
Figure 4:
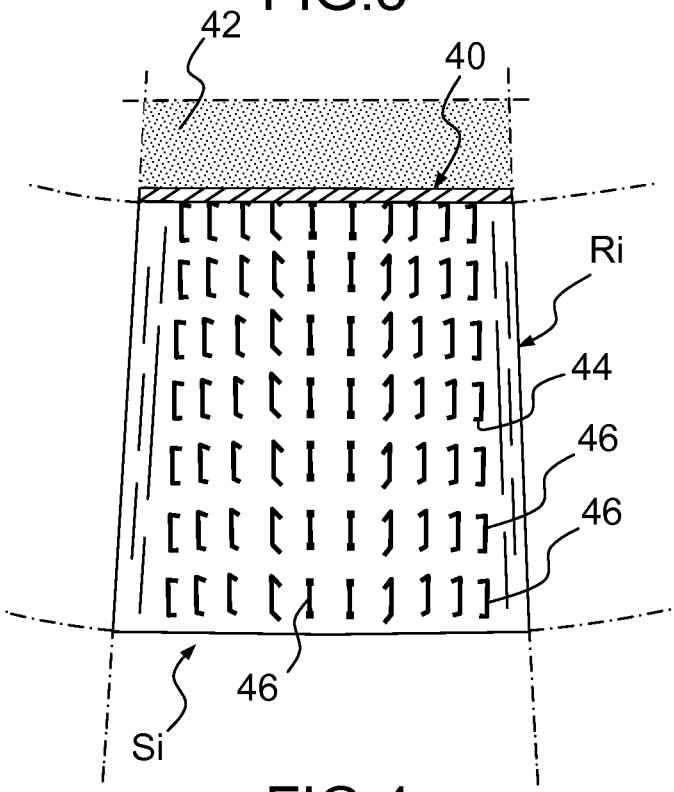
FIG. 4, already described, shows a partial view of an exemplary embodiment of the pyrotechnic charge of FIG. 3.
Figure 5:
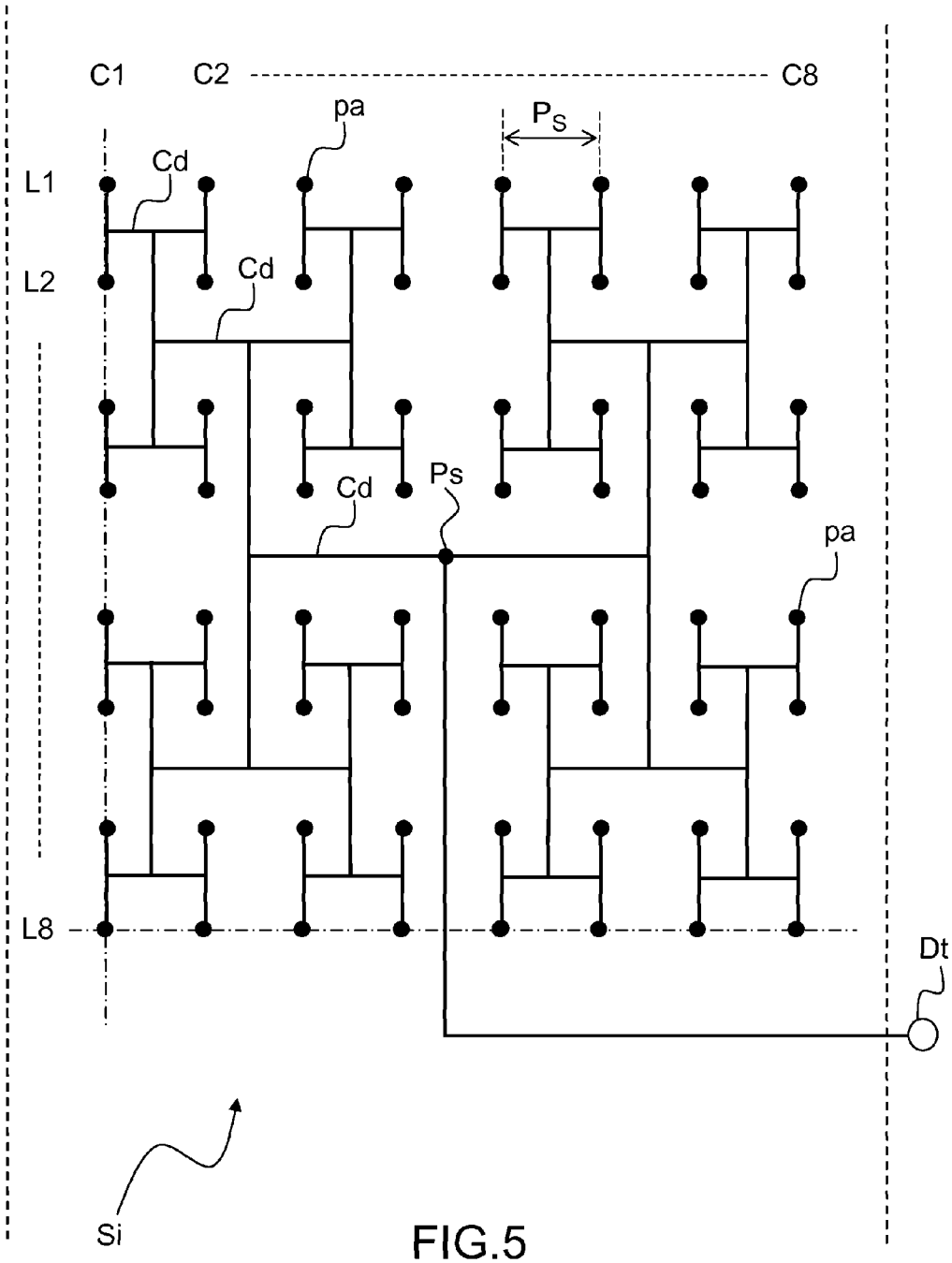
FIG. 5, already described, shows a network with multiple synchronous ignition points of the state of the art.
Figure 6:
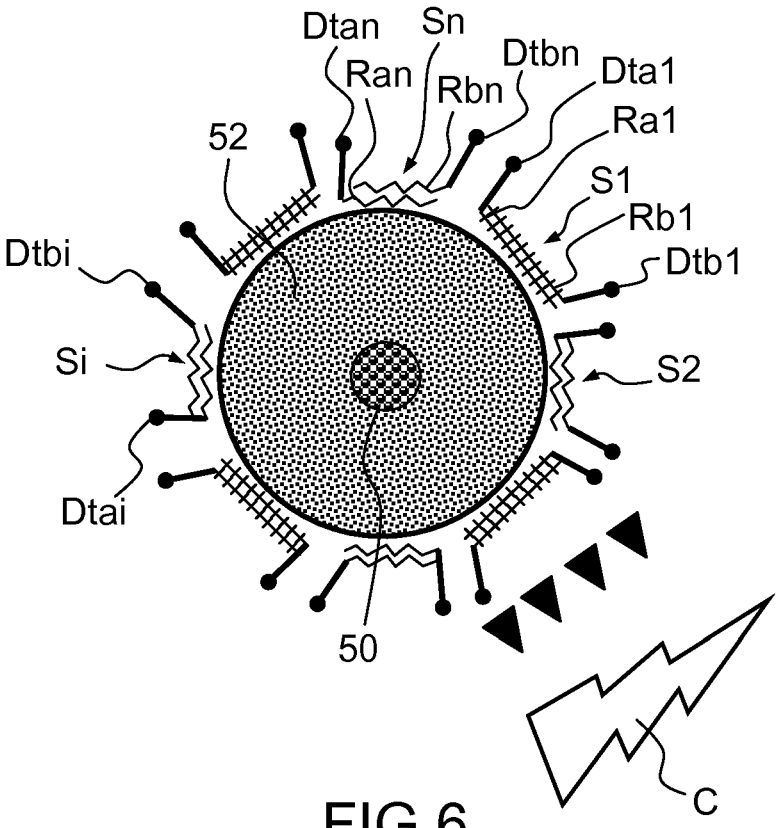
FIG. 6 shows an oriented multiple-burst pyrotechnic charge according to the invention.

FIG. 6 shows an oriented multiple-burst pyrotechnic charge according to the invention.

The pyrotechnic charge of FIG. 6 comprises an explosion generator 50 placed at the center of an explosive charge (or explosive) 52.

The surface of the explosive charge is divided into segments 51, S2, . . . Si, . . . Sn each comprising, and according to a main characteristic of the invention, interleaved partial ignition networks.

For example, in the case of the pyrotechnic charge of FIG. 6, each of the segments comprises two partial networks Ra1, Rb1, for the segment S1, Ra2, Rb2, for the segment S2, Rai, Rbi for the segment Si of number i and so on to the last segment Sn comprising the networks Ran and Rbn.

Each of the two interleaved partial networks of the pyrotechnic charge comprises a respective detonator sited remotely from the explosive surface for its activation, Dta1 for the network Ra1, Dtb1 for the other network Rb1 of the segment S1, Dta2 for the network Ra2, Dtb2 for the other network Rb2 of the segment S2, and so on to the last two detonators Dtan for the network Ran, Dtbn for the other network Rbn of the segment Sn.

All the detonators of the ignition networks covering the surface of the periphery of the explosive are remotely sited in a single smart safety and ignition device (with the acronym DSMF) (not represented in the figure).

Each of the n segments S1, S2, . . . Si, . . . Sn comprises kq multiple ignition points p11, p12, . . . pxy, . . . pkq in contact with said outer surface of the explosive to ignite the explosive, k and q being integer numbers greater than 1, x and y respectively defining the position of the point pxy in the row Lx and the column Cy.

According to a main characteristic of the invention, the kp multiple ignition points of the surface of the explosive are linked by ignition lines forming, in each of the segments S1, S2, . . . Si, . . . Sn, the interleaved partial networks.

The two interleaved networks preferably have an even number of identical ignition points for each row of points, with k=p, making it possible to simply link all the points of each of the partial networks and obtain a synchronous detonation of all the ignition points of the explosive.

In such a configuration with two partial networks Rai, Rbi, the half kq/2 of the ignition points Pxy distributed over the surface of a segment Si concerned belongs to one of the networks Rai, the other half pk/2 of the ignition points distributed over said surface of the segment concerned Si belonging to the other network Rbi.

We will now describe, as an example, the two interleaved networks of the segments of the pyrotechnic charge according to the invention of FIG. 6.

Figure 7A:
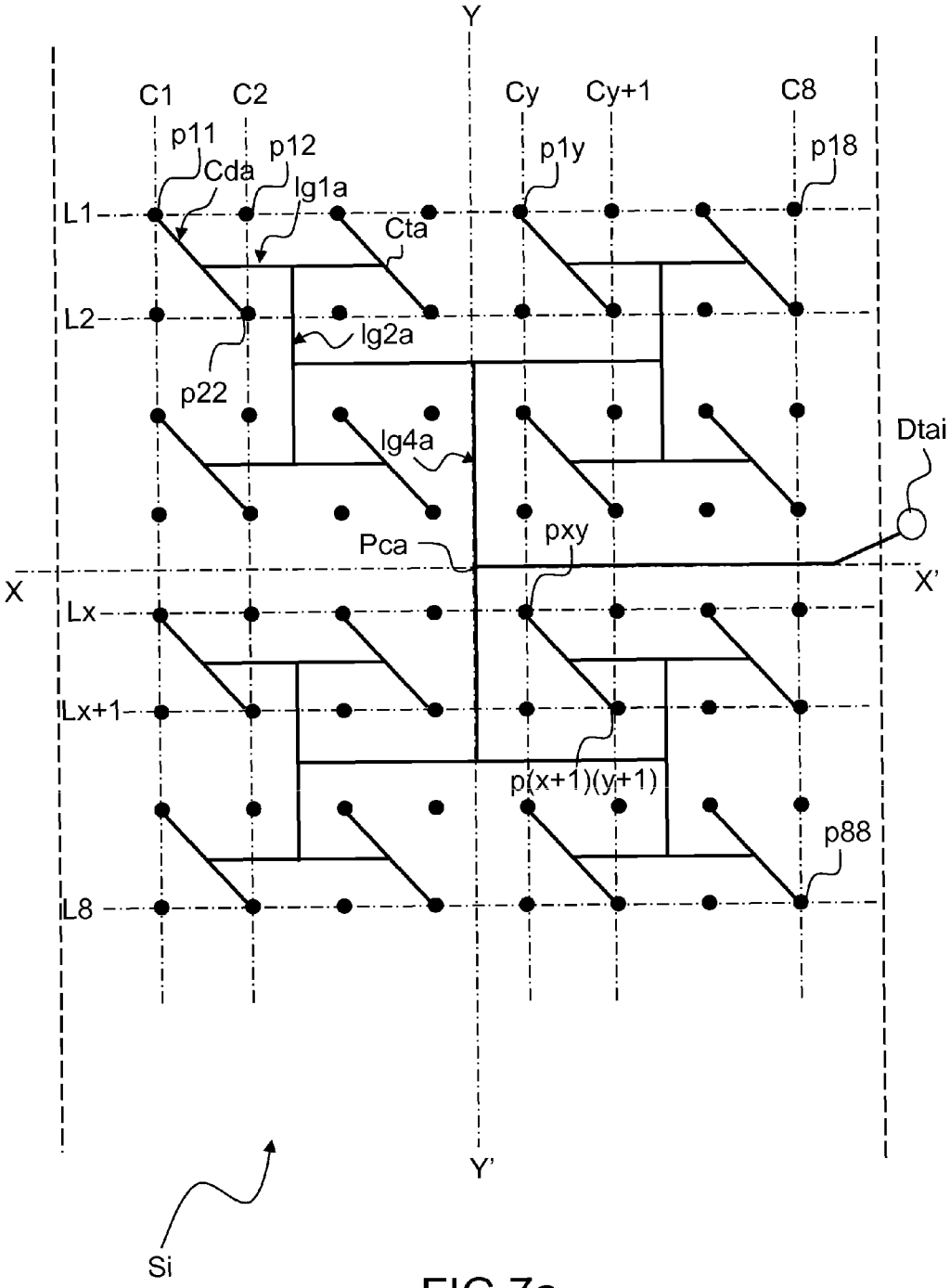
FIG. 7*a* shows one of the interleaved partial networks of a segment Si of number i of a pyrotechnic charge according to the invention.

FIG. 7*a* shows one of the interleaved partial networks of a segment Si of number i of the pyrotechnic charge according to the invention.

Figure 7B:
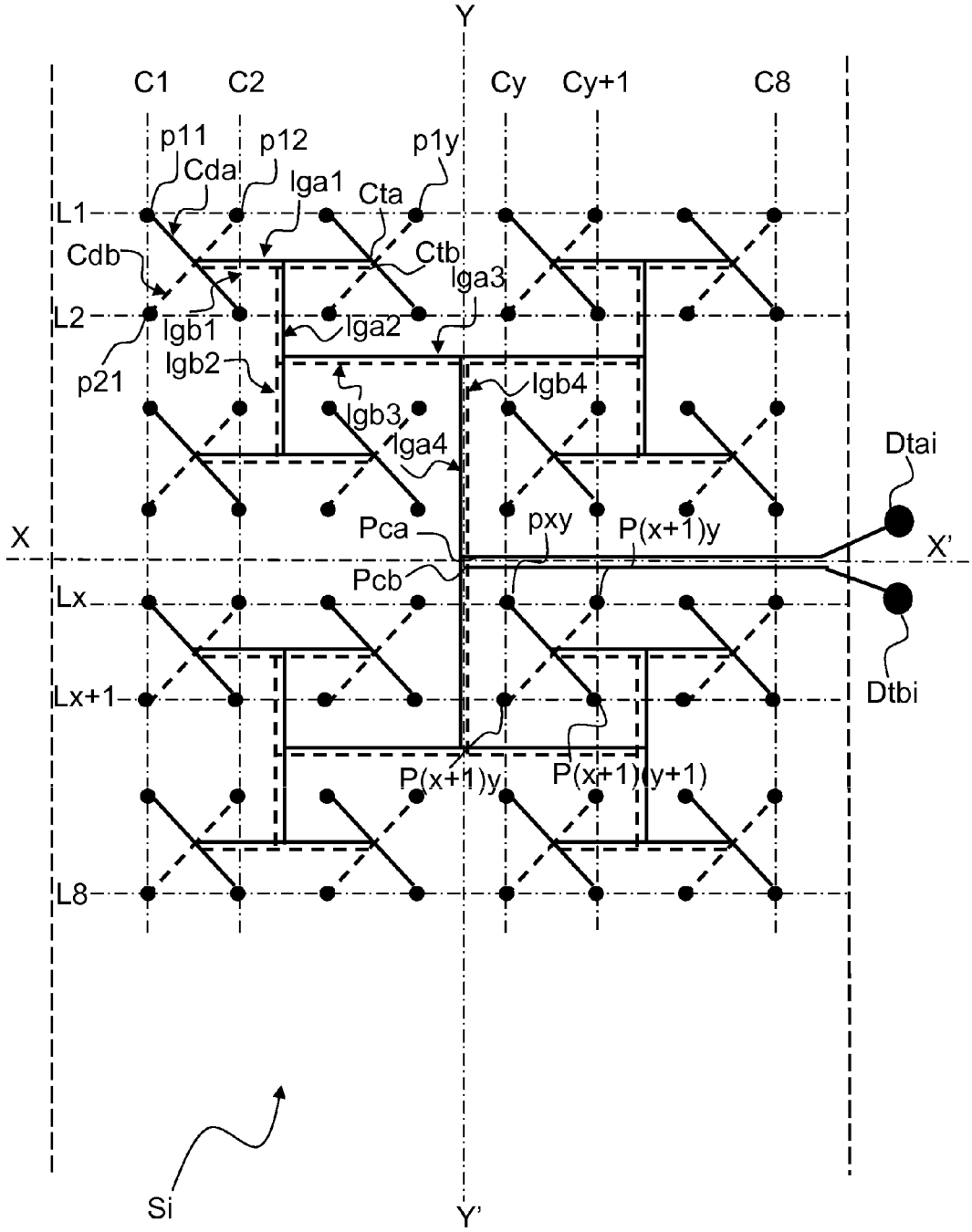
FIG. 7*b* shows two interleaved partial networks of the segment Si of number i of a pyrotechnic charge according to the invention.

FIG. 7*b* shows the two interleaved partial networks of the segment Si of number i of said pyrotechnic charge according to the invention.

In this exemplary embodiment of FIGS. 7*a* and 7*b*, a segment Si of the surface of the explosive comprises eight rows L1, L2, . . . L8 (q=8) of eight ignition points p11, p12, . . . p18 for each row, the points of the same number in the rows also forming columns C1, C2, . . . C8. (k=8). The ignition points pxy are identified on the square by their row number x (L1 to Lq) and their column number y (C1 to Ck).

All the kq ignition points are distributed over a square surface with perpendicular axes XX' parallel to the rows of the networks and YY' parallel to the columns of the networks and passing through a respective central distribution point Pca, Pcb for ignition of each of the partial networks Ra, Rb.

According to another main characteristic of the invention, all the kq ignition points are linked by ignition lines to form two interleaved partial networks, a partial network Ra and another interleaved network Rb.

In a preferential configuration of the interleaved partial networks Ra, Rb:

The partial network Ra (see FIG. 7*a*) comprises the ignition point p11, of the row L1 and column C1, linked by an individual ignition line Cda to the ignition point p22 of column C2 and row L2 to form an individual ignition pattern Ma of the partial network Ra, this individual ignition pattern of the partial network Ra being repeated one ignition point out of two along the rows L1 to Lk and along the columns C1 to Cq.

The other partial network Rb (in dotted lines in FIG. 7*b*) comprises the ignition point p12, of row L1 and column C2, linked by another individual ignition line Cdb to the ignition point p21, of row L2 and column C1, to form another individual ignition pattern Mb of the other partial network Rb, this other individual ignition pattern of the other partial network Rb is repeated one ignition point out of two along the rows L1 to Lk and along the columns C1 to Cq.

In this embodiment of FIGS. 7*a* and 7*b*, the individual lines Cda, Cdb are perpendicular to one another and form an angle of 45° relative to the axis YY' or XX'.

The centers Cta, Ctb of the respective individual ignition lines Cda, Cdb are linked by other ignition lines.

These other ignition lines are configured so that the distances traveled by a detonation wave applied by a respective detonator Dtai, Dtbi, of the segment Si concerned, at a respective central distribution point Pca and Pcb of the two networks Ra, Rb of said segment concerned Si, to the multiple ignition points of the segment Si of the pyrotechnic charge are identical, producing a synchronous activation of all said multiple ignition points of the two networks Ra, Rb.

FIG. 7*b* shows two interleaved partial networks, the network Ra by solid lines and the network Rb by dotted lines with the other ignition lines.

The other ignition lines are:

1) for the network Ra:
   - first lines Iga1 linking the center Cta of two consecutive individual lines Cda parallel to the axis XX',
   - second lines Iga2 parallel to the axis YY' linking the centers of the first lines Iga1,
   - third lines Iga3 parallel to the axis XX' linking the centers of two consecutive second lines along the axis XX',
   - two last lines Iga4 parallel to the axis YY' linking the centers of the two third lines Iga3 to the central point Pca of the partial network Ra.

2) for the other network Rb:

first lines Ig1b linking the center Ctb of two consecutive individual lines Cdb parallel to the axis XX', second lines Igb2 parallel to the axis YY' linking the centers of the first lines Ig1b, third lines Igb3 parallel to the axis XX' linking the centers of two consecutive second lines along the axis XX', two last lines Igb4 parallel to the axis YY' linking the centers of the two third lines Igb3 to the central point Pcb of the partial network Rb.

The ignition lines of each of the interleaved partial networks are produced by passages for the ignition lines and points of the networks into a jacket of the explosive charge having good detonic insulation characteristics.

To this end, the explosive charge is surrounded by a jacket comprising the multiple interleaved networks.

For example, the jacket may be made of plastic.

In an exemplary embodiment, the jacket may comprise two layers in the form of circular tubes fitted into one another, each of the tubes comprising the ignition lines and points of a respective partial network Rai, Rbi.

In another embodiment, the passages for the lines and crossmembers of the ignition points may be produced in a single jacket by molding.

The designer of the pyrotechnic charge according to the invention will determine the pitch Pp between the kq multiple ignition points according to the sensitivity of the explosive and so that the accidental initiation of a partial network Ra or Rb does not produce the nominal ignition of the pyrotechnic charge.

The embodiment described, of the pyrotechnic charge with multiple networks according to the invention, is not limiting. In practice, in the embodiment of FIG. 6, the explosion generator is inside the explosive. In other embodiments, the explosion generator may be positioned outside the explosive. The explosion generator being, in these other embodiments, for example, in the form of a jacket surrounding the explosive, said explosive having, in direct contact with its outer surface, the interleaved partial synchronous ignition networks.

A main advantage of the pyrotechnic charge according to the invention is that it retains the ignition principle based on a network of distribution of the ignition (or initiation) points while remaining much less vulnerable to the effects of external impact.

The combined operation of all the temporally controlled partial networks is alone capable of reproducing the nominal conditions for initiation of the explosive charge that would be provided by a single network.

The untimely or accidental operation of a partial network is incapable of producing a nominal ignition of the explosive charge, either because the number of ignition points activated is insufficient in number for the ignition effect, or because the ignition points that are activated accidentally are so activated in a manner that is sufficiently desynchronized to avoid the ignition effect.

The partial networks described are not limiting and other partial networks can be envisaged to reduce the vulnerability of the pyrotechnic charges for the oriented multiple-burst military warheads.

The invention claimed is:

1. A pyrotechnic charge comprising an explosion generator; and an explosive having an outer surface divided into n segments, each segment comprising kq multiple ignition points for the explosive, k and q being integer numbers greater than 1, wherein the kq multiple ignition points for each segment of the explosive are linked by ignition lines forming, for each segment, at least two interleaved partial networks for the synchronous ignition of the kq multiple ignition points, each of the partial networks being linked to a respective partial network detonator.

2. The pyrotechnic charge according to claim 1, wherein each segment of the outer surface of the explosive comprises two interleaved partial synchronous ignition networks.

3. The pyrotechnic charge according to claim 2, wherein, k and q being even numbers, the kq multiple ignition points form a part by half kq/2 of each of the two interleaved partial networks, each of the two halves of the multiple ignition points being distributed over the surface of the explosive of the segment concerned.

4. The pyrotechnic charge according to claim 3, wherein the kq multiple ignition points of each of the segments are distributed over the surface of the explosive on k rows and q columns, and according to a distribution pitch, a partial synchronous ignition network of a segment being obtained from the other synchronous ignition network of the same segment by rotation of 180° about an axis YY' parallel to the direction of the columns and passing through a respective central point of distribution of the ignition lines of each of the partial networks.

5. The pyrotechnic charge according to claim 4, wherein a first partial network of a first segment comprises a first ignition point of a first row and a first column linked by an individual ignition line to a second ignition point, of a second column adjacent to the first column and a second row adjacent to the first row to form a first individual ignition pattern of the first partial network, this individual ignition pattern of the first partial network being repeated one ignition point out of two along the k rows and along the q columns, and a second partial network of the first segment comprises a third ignition point, of the first row and the second column linked by another individual ignition line to a fourth ignition point, of the second row and the first column, to form a second individual ignition pattern of the second partial network, this second individual ignition pattern being repeated one ignition point out of two along the k rows and along the q columns.

6. The pyrotechnic charge according to claim 5, wherein the centers of the first and second individual ignition lines are linked by other ignition lines configured so that the distances traveled by the detonation waves for the detonators, of the first segment, applied to each respective central distribution point of the networks, to the multiple ignition points of the first segment are identical, producing a synchronous activation of all said multiple ignition points of the first and second partial networks.

7. The pyrotechnic charge according to claim 6, wherein the other ignition lines are:

first lines linking the centers of two consecutive individual lines parallel to the axis XX', second lines parallel to the axis YY' linking the centers of two first lines, third lines, parallel to the axis XX', linking the centers of two consecutive second lines along the axis XX', two last lines parallel to the axis YY' linking the centers of the two third lines to the central distribution point of the respective partial network.

8. The pyrotechnic charge according to claim 4, wherein the kq multiple ignition points of a segment are distributed over a square surface of perpendicular axes XX' parallel to the rows and YY' parallel to the columns of the partial networks and passing through the central distribution point.

9. The pyrotechnic charge according to claim 4, wherein the distribution pitch of the multiple ignition points is chosen according to the sensitivity of the explosive and so that an accidental initiation of a partial network does not produce the nominal ignition of the pyrotechnic charge.

10. The pyrotechnic charge according to claim 1, wherein the segments each comprise 64 multiple ignition points with k=q=8.

11. The pyrotechnic charge according to claim 1, wherein the explosion generator is on the periphery of the charge surrounding the explosive having a jacket over its outer surface comprising the multiple interleaved networks.

12. The pyrotechnic charge according to claim 11, wherein the jacket comprises two layers in the form of circular tubes fitted into one another, each of the tubes comprising the ignition lines and points of a respective partial network.

13. The pyrotechnic charge according to claim 11, wherein the jacket is made of plastic.

14. The pyrotechnic charge according to claim 1, wherein the explosion generator is inside the charge having a jacket over its outer surface comprising the multiple interleaved networks.

* * * * *

UNITED STATES PATENT AND TRADEMARK OFFICE

CERTIFICATE OF CORRECTION

PATENT NO. : 8,479,653 B2
APPLICATION NO. : 13/139304
DATED : July 9, 2013
INVENTOR(S) : Bar et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 52 days.

Signed and Sealed this
Eighth Day of September, 2015

Michelle K. Lee

Michelle K. Lee
*Director of the United States Patent and Trademark Office*